US005711114A

United States Patent [19]

Mueller

[11] Patent Number: 5,711,114

[45] Date of Patent: Jan. 27, 1998

[54] SNOW RETENTION ASSEMBLY AND METHOD OF USING THE SAME

[76] Inventor: George B. Mueller, 3540 Chalet, Crete, Ill. 60417

[21] Appl. No.: 441,094

[22] Filed: May 15, 1995

[51] Int. Cl.[6] ..... E04D 13/10

[52] U.S. Cl. ..... 52/24; 52/630; 52/746.11

[58] Field of Search ..... 52/24, 478, 520, 52/630, 25, 26, 536, 537, 528, 746.11

[56] References Cited

U.S. PATENT DOCUMENTS

| | | | |
|---|---|---|---|
| 369,257 | 8/1887 | Martz | 52/25 |
| 1,095,822 | 5/1914 | Danzer | 52/25 |
| 1,463,065 | 7/1923 | Sieger | 52/24 |
| 1,475,931 | 12/1923 | Campbell | 52/24 |
| 1,572,377 | 2/1926 | Blair | 52/630 X |
| 2,041,929 | 5/1936 | Hitzman | 52/24 X |
| 3,313,069 | 4/1967 | Jackson | 52/24 |
| 3,583,113 | 6/1971 | Winski | 52/24 X |
| 4,499,700 | 2/1985 | Gustafsson | 52/630 X |
| 5,044,130 | 9/1991 | Chiddister | 52/24 |
| 5,205,088 | 4/1993 | Mueller | 52/24 |
| 5,343,659 | 9/1994 | Zaleski | 52/26 X |
| 5,349,791 | 9/1994 | Zaleski | 52/24 |

FOREIGN PATENT DOCUMENTS

| | | | |
|---|---|---|---|
| 158802 | 6/1994 | Japan | 52/24 |
| 462431 | 10/1968 | Switzerland | 52/24 |

OTHER PUBLICATIONS

Mullane, "Snow Guards, Tidal Surges and Roofing Poems", Roofer Magazine, vol. 15, No. 4, p. 6 (Apr. 1995).

*Primary Examiner*—Carl D. Friedman
*Assistant Examiner*—Aimee E. McTigue
*Attorney, Agent, or Firm*—Bernard L. Kleinke; Peter P. Scott

[57] ABSTRACT

The rooftop snow retention assembly includes at least one upstanding projection connected integrally to a top surface of a roof. An elongated upper wall portion of the projection cooperates with a snow guard positioned adjacent to the projection. The snow guard includes an upright wall member to engage the snow or ice and a base member bonded to the top surface, wherein the base member substantially abuts the upper wall portion to help resist the snow guard from moving downwardly. A pair of leg members extend downwardly from the base member on either side of the projection to further brace the snow guard against shear forces applied by the accumulated snow or ice.

16 Claims, 2 Drawing Sheets

SNOW RETENTION ASSEMBLY AND METHOD OF USING THE SAME

TECHNICAL FIELD

The present invention relates in general to an improved snow retention assembly and a method of using it. The invention more particularly relates to a snow retention assembly and method of using it for helping to prevent avalanches of accumulated snow or ice off of a roof.

BACKGROUND ART

The dangers posed by avalanches of accumulated snow or ice on a steep roof are well known. For example, U.S. Pat. No. 5,205,088 describes potential hazards related to the accumulation of snow or ice on a roof and discloses a metal roofing panel construction for helping to prevent or at least reduce greatly dangerous avalanches of accumulated snow or ice.

The metal roofing panel construction disclosed in U.S. Pat. No. 5,205,088, which is incorporated by reference as if fully set forth herein, does not require special installation procedures and is inexpensive to install. In this regard, the disclosed metal roofing construction includes a plurality of metallic panels adapted to abut one another to cover a pitched building surface. A number of upstanding projections are formed in each panel by a roll-forming technique, or any other suitable method, to hold accumulated snow or ice in place.

The roofing construction disclosed in U.S. Pat. No. 5,205,088 satisfactorily maintains accumulated snow or ice in stasis on the roof. Under same conditions, the accumulation of very large amounts of snow or ice over an extended period of time can possibly have an added risk of avalanche. In this regard, alternating periods of warming and cooling when combined with periods of snowfall occurring over an extended period of time can produce a large quantity of accumulated snow or ice having layers of accumulated snow or ice wherein each of the layers has a different characteristic.

For example, accumulated snow from an early snowfall on a south facing roof tends to melt under the warmth of the sun. A period of cold temperatures can cause the melted snow to partially freeze, producing an unstable layer of snow or ice. A subsequent snowfall may deposit additional snow on top of the previously accumulated snow. As a result, the more recent snowfall can be supported by an unstable layer and is susceptible to sliding over the unstable layer, and can lead to an undesirable and dangerous avalanche.

Over the course of a winter, additional snowfalls can build up the overall depth of the accumulated snow or ice on the roof. The various temperature changes throughout the winter can create a number of layers of snow having different characteristics. As a result, the upper layers of a large amount of accumulated snow or ice can slide on top of lower layers due to intermediate unstable layers, even where the lower layers are suitably prevented from sliding downwardly.

Therefore, it would be highly desirable to have a new and improved snow retention assembly and method of using it, which controls the downward movement of a large accumulation of snow or ice on a pitched roof. Such a snow retention assembly should be easy to install, and should be relatively inexpensive to manufacture.

DISCLOSURE OF INVENTION

Therefore, the principal object of the present invention is to provide a new and improved snow retention assembly and a method of using it, wherein the snow retention assembly controls the downward movement of a large amount of accumulated snow or ice on a pitched roof, and which is easy to install and inexpensive to manufacture.

Briefly, the above and further objects of the present invention are realized by providing a new and improved rooftop snow retention assembly, which can be used according to a novel method.

The rooftop snow retention assembly includes at least one upstanding projection connected integrally to a top surface of a roof. An elongated upper wall portion of the projection cooperates with a snow guard positioned adjacent to the projection. The snow guard includes an upright wall member to engage the snow or ice and a base member bonded to the top surface, wherein the base member substantially abuts the upper wall portion to help resist the snow guard from moving downwardly. A pair of leg members extend downwardly from the base member on either side of the projection to further brace the snow guard against shear forces applied by the accumulated snow or ice.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
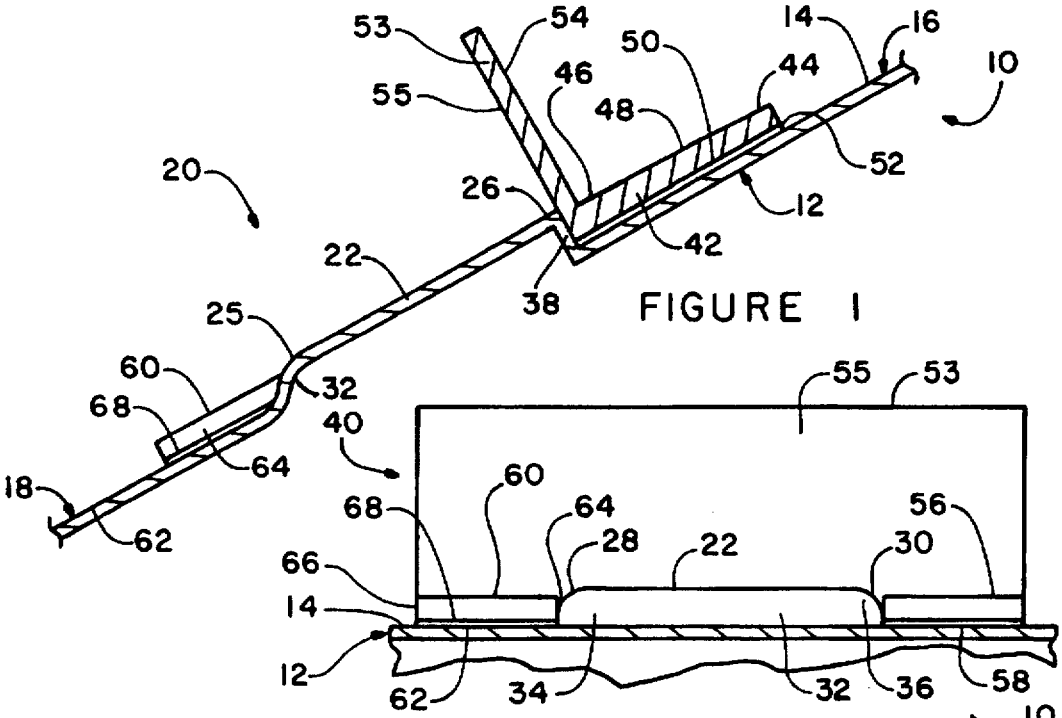
FIG. 1 is a sectional elevational view of a snow retention assembly, which is constructed in accordance with the present invention.
Figure 2:
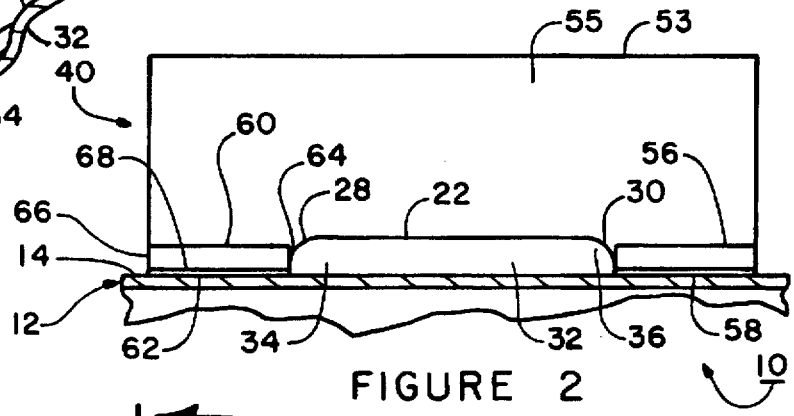
FIG. 2 is a rear elevational view of the snow retention assembly of FIG. 1.
Figure 3:
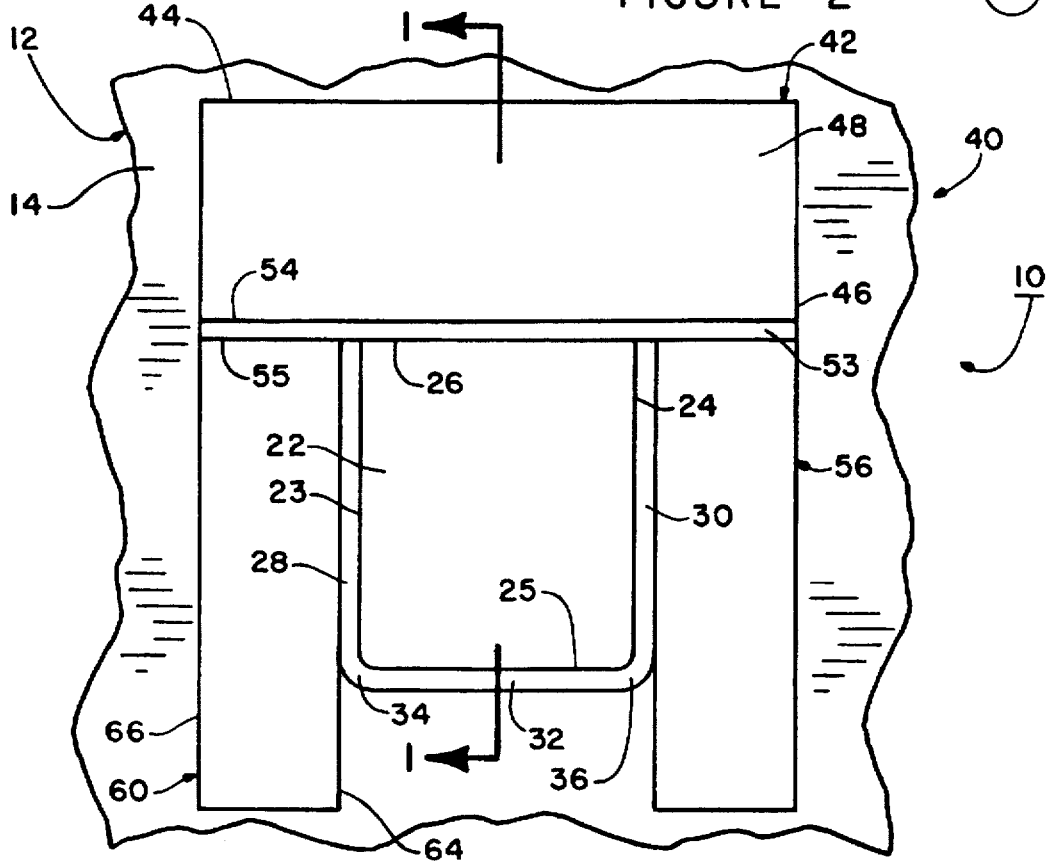
FIG. 3 is a plan view of the snow retention assembly of FIG. 1.

Referring now to the drawings, and in more particularly to FIGS. 1–3 thereof, there is shown a snow retention assembly 10, which is constructed in accordance with the present invention. The assembly 10 is adapted for use on building structures having a pitched roof employing a plurality of metallic roofing panels, such as roofing panel 12, for preventing or at least greatly reducing accumulated snow or ice from sliding down the roof.

The panel 12, is preferably composed of architectural sheet metal having a high resistance to corrosion. An exemplary panel 12 is described in U.S. Pat. No. 5,205,088.

The assembly 10 generally comprises an upstanding projection 20 extending upwardly from the roofing panel 12, and which is connected integrally to a top surface 14 of the roofing panel 12. An upper upstanding wall portion 38 extends upwardly away from the top surface 14 to define a front outer face for helping to arrest downward motion of the accumulated snow or ice on the roofing panel 12. The formation of the projection 20 is described in detail in U.S. Pat. No. 5,205,088, which is incorporated herein by reference.

A U-shaped barrier or snow guard 40 cooperates with the projection 20 for engaging the accumulated snow or ice on the roofing panel 12 to help hold back the accumulated snow or ice. The snow guard 40 abuts the upper wall portion 38 to help support the snow guard 40 from below to facilitate resisting the snow guard 40 from sliding downwardly along the roof under the weight of the snow or ice.

In use, the snow guard 40 is positioned on the top surface 14 at an area 16 to enable it to engage the projection 20. The snow guard 40 is adjusted to abut the upper wall portion 38. To help secure the snow guard 40 to the top surface 14, the snow guard 40 is bonded to the area 16 by an adhesive layer 52 upwardly of the projection 20.

Considering now the construction of the projection 20 in greater detail, the projection 20 includes a generally rectangular flat back member 22 having a left side 23, a right side 24, a downroof side 25 and an uproof side The left side 23 and the right side 24 are connected integrally to the top surface 14 by left edge portion 28 and right edge portion 30 respectively. As best seen in FIG. 2, left edge portion 28 and right edge portion 30 are curved to define a smooth interface between the back member 22 and the top surface 14.

A lower edge portion 32 integrally connects a downroof area 18 of the top surface 14 to the downroof edge 25. Intermediate curved edged portions 34 and 36 integrally connect the left edge portion 28 and the right edge portion 38, respectively, to the lower edge portion 32 to form a smooth continuous edge surface. The uproof side 26 is generally straight, thereby enabling the upper wall portion 38 to be generally flat for enabling the snow guard 40 to abut the upper wall portion 38 along substantially its entire length.

Considering now the snow guard 40 in greater detail, the snow guard 40 includes a base member 42 having a front end portion 44 and a rear end portion 46 to secure the snow guard 40 to the uproof area 16. The snow guard 40 is preferably formed from a plastic material which is resistant to damage and which is capable of being bonded to the top surface 14 in a relatively secure manner.

As shown in FIG. 1, the base member 42 is oriented on the uproof area 16 to position the rear end portion 46 downhill from the front end portion 44 to permit the rear end portion 46 to abut the upper wall portion 38. A bottom or bonding surface 50 of the base member 42 provides a surface for receiving the adhesive layer 52 to secure the base member 42 to the uproof area 16.

The thickness of the base member 42 varies between the front end portion and the back end portion to define a sloped top surface 48. In this regard, the top surface 48 slopes downwardly away from the front end portion 44 and also slopes outwardly away from the top surface 14.

In order to engage the accumulated snow or ice on the roofing panel 12, the snow guard member 40 further includes an upstanding wall member 53 connected integrally to the rear end portion 46. The wall member 53 includes a front or snow engaging surface 54 and a rear surface 55.

A pair of leg members such as right leg members 56 and left leg member 60, are connected integrally to the rear end portion 46 adjacent to the back surface 55. The leg members 56 and 60 extend downroof away from the base member 42 on either side of the projection 20 to conform to the shape of the projection 20. In this regard, the right leg member 56 abuts the right edge portion 30 while the left leg member 60 abuts the left edge portion 28 to further stabilize the snow guard 40.

As the right leg member 56 and the left leg member 60 are substantially similar, only the left leg member 60 will be described hereinafter in greater detail. The left leg member 60 is generally rectangular and includes an outside edge 66, and an inside edge 64 for engaging the left edge portion 28. An adhesive layer 62 bonds the left leg member 60 to the top surface 14 for enhancing the securing of the snow guard 40 to the top surface 14. Similarly, an adhesive layer 58 bonds the right leg member 56 to the top surface 14.

The right leg member 56, base member 42 and the left leg member 60 define a cavity which is adapted to receive the projection 20, wherein the left edge portion 28 and the right left portion 30 engage the left leg member 60 and the right leg member 56, respectively, to resist the snow guard 40 from pivoting about the projection 20. In the preferred embodiment, the right leg member 56 and the left member 60 extend downwardly beyond the lower edge portion 32 to the downroof area 18 for increasing the area of the snow guard 40 which is bonded to the top surface 14. In this way, the ability of the snow guard 40 to prevent the accumulated snow or ice from moving downroof is enhanced.

Figure 4:
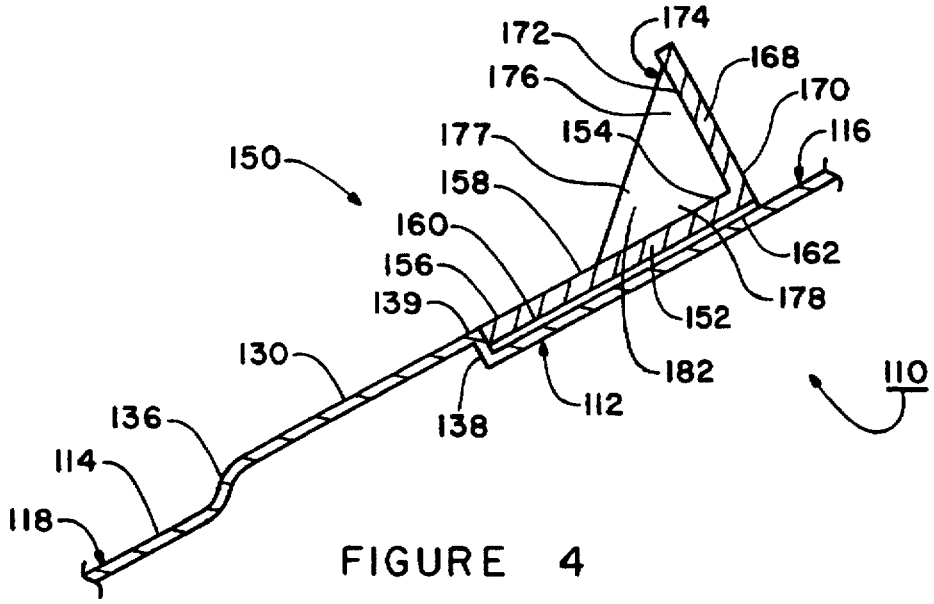
FIG. 4 is a sectional elevational view of another snow retention assembly, which is also constructed in accordance with the present invention.
Figure 5:
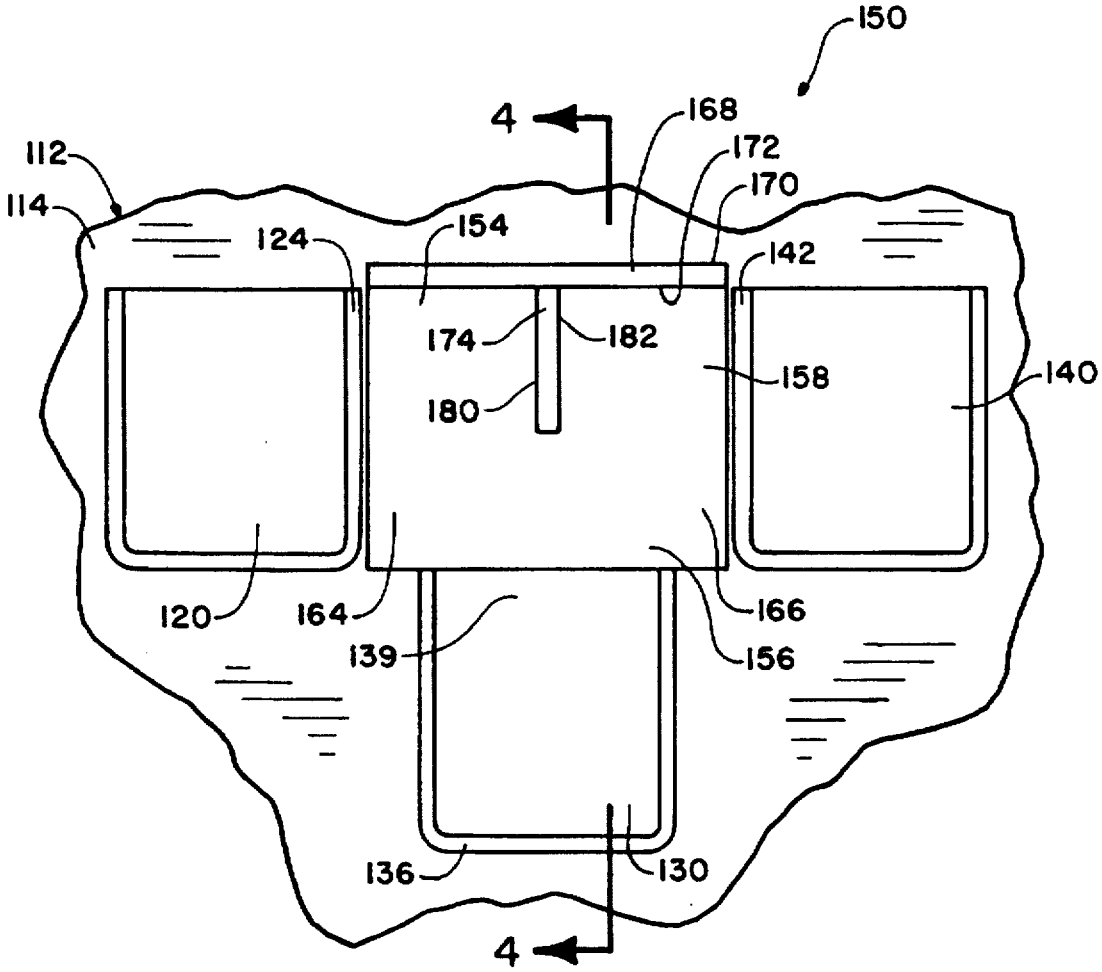
FIG. 5 is a plan view of the snow retention assembly of FIG. 4.

Referring now to FIGS. 4–5 there is shown another snow retention assembly 110 which is also constructed in accordance with the present invention. The assembly 110, includes the left projection 120, a lower projection 130 and a right projection 140 which are all similar to the projection 20 show in in FIGS. 1–3. A snow guard 150 cooperates with the left projection 120, the lower projection 130 and the right projection 140 to help hold the accumulated snow or ice in stasis on the roofing panel 112.

The snow guard 150 includes a base member 152 having a front end portion 154 and a rear end portion 156. A bottom or bonding surface 160 enables the base member 152 to be bonded to an uproof area 116 with an adhesive layer 162.

The base member 142 is oriented on the uproof area 116 to position the front end portion 154 uproof from the rear end portion 156, wherein the rear end portion 156 abuts an upper wall portion 138. A left side portion 164 and a right side portion 166 of the base member 152 are adapted to abut a right edge portion 124 of the left projection 120 and a left edge portion 142 of the right projection 140, respectively.

An upstanding wall member 168 having a front surface 170 and a back surface 172 is connected integrally to the front end portion 154 to define a surface for engaging the accumulated snow or ice. A triangular rib member 174 having sides 180 and 182 is connected between the wall member 168 and the base member 152 to brace the wall member 168, thereby preventing the wall member 168 from pivoting backwardly about the front end portion 154. The rib member 174 further includes a hypotenuse edge portion 177, a forward edge portion 176 for engaging the back surface 172 and a bottom edge portion 178 for engaging the upper surface 158.

In use, the base member 152 of the snow guard 150 is oriented relative to the lower projection 130 to position the rear end portion 156 downroof from the front end portion 154. The rear end portion 156 is positioned to abut the upper wall portion 138 to facilitate resisting the snow guard 150 from moving downroof. The base member 152 is bonded by the adhesive layer 162 to the uproof area 116 to help prevent the snow guard 150 from moving downroof.

To limit the pivotal movement of the snow guard 150, the left side portion 164 is positioned adjacent to the left edge portion 124 and the right side portion 166 is positioned adjacent to the left edge portion 142 to enable the left side portion 164 to substantially abut the left projection 120, and to enable the right side portion 166 to substantially abut the right projection 140.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A two-piece snow retention assembly for holding accumulated snow or ice in equilibrium on a top surface of a sloped roof, comprising:

a first piece comprising an upstanding projection having an elongated upper upstanding wall portion, said upstanding projection adapted to extend upwardly from the roof and integrally connect to the top surface;

said wall portion having a front outer face;

means for integrally connecting said wall portion to the roof top surface;

a second piece comprising a separate snow guard means adapted to be positioned on said top surface for engaging the snow or ice to help hold back the accumulated ice or snow;

means for mounting said snow guard means in abutting relationship with the projection upper wall portion for supporting said separate snow guard means from a downroof position to facilitate resisting said snow guard means from moving downroof along the top surface; and wherein said separate snow guard means includes a base member adapted to be affixed to the roof top surface, said separate snow guard means including an upstanding wall member connected to said base member for engaging the accumulated snow or ice on the roof top surface, and said snow guard base member having a rear end portion abutting said upper wall portion at its front outer face to enable said projection to help resist said snow guard means from moving downroof along the roof top surface under the weight of the accumulated snow or ice.

2. A snow retention assembly according to claim 1, wherein said base member extends over an uproof area of the top surface adjacent to said upper wall portion;

said base member is oriented on said uproof area to position said rear end portion downroof from a front end portion, wherein said rear end portion substantially abuts said upper wall portion; and said snow guard means further including a wall member connected integrally to said base member and extending upwardly away therefrom to provide a snow or ice engaging surface for engaging the accumulated snow or ice to help limit the downroof movement of the snow or ice.

3. A snow retention assembly according to claim 2, further including adhesive means for bonding said base member to said uproof area to help prevent said snow guard means from moving downroof.

4. A snow retention assembly according to claim 3, wherein said upstanding projection further includes a left edge portion and a right edge portion;

said snow guard means is U-shaped and further includes a left leg member connected integrally to said rear end portion and adapted to extend downroof therefrom along the top surface adjacent to said left edge portion; and said snow guard means further includes a right leg member connected integrally to said rear end portion and adapted to extend downroof therefrom along the top surface adjacent to said right edge portion for helping to resist said snow guard means from pivoting on the top surface about said upstanding projection.

5. A snow retention assembly according to claim 4, wherein said adhesive means is further adapted to bond said left leg member to the top surface adjacent to said left edge portion and said right leg member to the top surface adjacent to said right edge portion to further resist said snow guard means from moving downroof.

6. A snow retention assembly according to claim 5, wherein said wall member is connected integrally to said base member at said rear end portion.

7. A snow retention assembly according to claim 6, wherein the thickness of said base member varies between said front end portion and said rear end portion to form a sloped top surface, said sloped top surface is adapted to slope downwardly away from said front end portion and outwardly away from the top surface of the roof.

8. A snow retention assembly according to claim 7, wherein said upstanding projection further includes a lower edge portion, each one of said left leg member and said right leg member have a bonding surface for engaging the top surface, and said left leg member and said right leg member are adapted to extend downroof along the top surface beyond said lower edge portion to increase the area which is bonded to the top surface for enhancing the securing of said snow guard means to the top surface.

9. A snow retention assembly according to claim 3, wherein said wall member is connected integrally to said base member at said front end portion.

10. A snow retention assembly according to claim 9, wherein said wall member includes a back surface and said base member includes an upper surface, said snow guard means further includes a rib member connected between said back surface and said upper surface to brace said wall member for preventing it from pivoting backwardly about said front end portion toward said upper surface.

11. A snow retention assembly according to claim 10 further including a left upstanding projection and a right upstanding projection located uproof from said upstanding projection for helping to prevent said snow guard means from pivoting about said upstanding projection on the top surface, wherein said base member further includes a left edge portion and a right edge portion, and said left edge portion is positioned adjacent to said left upstanding projection and said right edge portion is positioned adjacent to said right upstanding projection for facilitating the limitation of the rotation of said snow guard means relative to the roof.

12. A method of assembling a two-piece snow retention assembly onto a top surface of a sloped roof, comprising:

using a two-piece snow retention assembly having one piece comprising an upstanding projection extending upwardly from and integrally formed in the roof top surface and having an elongated upper upstanding wall portion, and a second piece comprising a separate snow guard means having a base member and a wall member connected to said base member and extending upwardly therefrom, said base member having a front edge portion and a rear edge portion;

orienting said base member relative to the roof top surface to position said rear end portion downroof from said front end portion;

positioning said snow guard means onto the top surface of the roof;

positioning the snow guard base member rear edge portion to abut a front face of said integrally formed projection upstanding wall portion for enabling the projection to resist said snow guard means from moving downroof along the top surface under the weight of the accumulated snow and ice; and affixing said base member to said roof top surface to help secure said separate snow guard means in place.

13. A method of holding accumulated snow and ice according to claim 12, further including bonding said base member to an uproof area of the roof adjacent to said upper wall portion to help secure said snow guard means to the top surface.

14. A method of holding accumulated snow and ice according to claim 12, further including:

using a left leg member and a right leg member connected integrally to, and extending downroof away from, said rear end portion, and said upstanding projection further including a left edge portion and a right edge portion;

positioning said left leg member adjacent to said left edge portion; and positioning said right leg member adjacent to said right edge portion for helping to resist said snow guard means from pivoting on the top surface about said upstanding projection.

15. A method of holding accumulated snow and ice according to claim 14, further including bonding said left leg member and said right leg member to the top surface.

16. A method of holding accumulated snow and ice according to claim 12, further including:

using a left upstanding projection and a right upstanding projection located uproof from said upstanding projection, said base member further having a left side portion and a right side portion;

positioning said snow guard means between said left upstanding projection and said right upstanding projection to enable said left side portion to substantially abut said left upstanding projection and to enable said right side portion to substantially abut said right upstanding projection.

* * * * *